United States Patent [19]

Baptist

[11] 4,053,098

[45] Oct. 11, 1977

[54] SHIPPING CARTON

[75] Inventor: Brian Kent Baptist, San Jose, Calif.

[73] Assignee: International Paper Company, New York, N.Y.

[21] Appl. No.: 713,195

[22] Filed: Aug. 10, 1976

Related U.S. Application Data

[63] Continuation-in-part of Ser. No. 576,717, May 12, 1975, abandoned.

[51] Int. Cl.[2] ..... B65D 13/04; B65D 5/02

[52] U.S. Cl. ..... 229/23 R; 229/44 R; 229/40; 229/6 A

[58] Field of Search ..... 229/23 C, 23 R, 40, 229/44 R, 45, 43, DIG. 11, 34 R

[56] References Cited

U.S. PATENT DOCUMENTS

| | | | |
|---|---|---|---|
| 1,622,525 | 3/1927 | Lemon | 229/23 R |
| 2,319,924 | 5/1943 | Ferguson | 229/43 X |
| 2,721,689 | 10/1955 | Nye | 229/40 |
| 3,520,468 | 7/1970 | Wiemann | 229/45 |
| 3,623,650 | 11/1971 | Watts | 229/45 X |
| 3,695,219 | 10/1972 | Arian | 113/50 |
| 3,713,579 | 1/1973 | Chaffers | 229/44 R |
| 3,899,121 | 8/1975 | Herbetko | 229/6 A X |

FOREIGN PATENT DOCUMENTS

| | | | |
|---|---|---|---|
| 556,550 | 2/1957 | Italy | 229/DIG. 11 |

*Primary Examiner*—Davis T. Moorhead
*Attorney, Agent, or Firm*—Charles B. Smith

[57] ABSTRACT

A shipping carton for storage and/or transport of produce under cold and/or humid conditions comprising an erected body wrap and end wall pieces positioned at opposite ends of the body wrap. The end wall pieces are impregnated with a moisture resistant agent and stacking tabs are provided on the top of the carton. Preferably, the tabs have a structure corresponding to the structure of the bottom corners of a second similar carton stacked thereon, whereby they prevent the relative shifting of the cartons.

2 Claims, 10 Drawing Figures

SHIPPING CARTON

BACKGROUND OF THE INVENTION

This is a continuation-in-part application of U.S. patent appliction Ser. No. 576,717, filed on May 12, 1975 now abandoned.

RELATED APPLICATION

My copending application Ser. No. 719,410 filed Sept. 1, 1976 discloses stacking tabs similar to one embodiment of those disclosed herein but in a carton of different construction.

This invention relates to ventilated shipping cartons having a relatively high stacking strength and, more particularly, to such cartons for transporting produce such as fruits and vegetables or the like which for any of a variety of reasons must be cooled or maintained at a certain temperature during transit.

It is known that many fruits and vegetables respire and generate heat at different rates even after they have been harvested. It is also known that heat accelerates the deterioration of fruits and vegetables, which may create problems in the long periods of time and distances that often must be negotiated before such commodities reach the marketplace. This is usually combated by cooling the produce to a desired temperature and maintaining this temperature in storage and transit. This temperature is often well below 50° F. and is maintained under highly humid conditions (usually greater than 90% relative humidity), so that the produce does not become dehydrated. This cooling to establish a desirable temperature is achieved and maintained by a variety of methods, which are known in the art, with the common denominator of these methods being that relatively cold, highly humid conditions must be maintained from the time of harvesting the produce until its deliverance to the marketplace. Thus, one requirement of a carton utilized for shipping such commodities is that the carton be capable of maintaining the commodities at a desired temperature.

A second requirement of such a carton is that the carton be capable of stacking for long periods of time under the above-described conditions of temperature and humidity. At the present time, the wood box lug and various derivatives thereof, i.e. wood and veneer combinations, are widely used in the construction of produce shipping boxes. These wood boxes are commonly ventilated and offer ample protection to the produce packed therein due to the basic properties of wood, i.e. structural strength that does not appreciably deteriorate under long periods of stacking, subjection to high weights, and the above-described conditions of temperature and humidity. Wood boxes, although possessing structural qualities advantageous in storing and shipping produce, have several shortcomings. For example, if shifting during the handling and transit of these wood boxes is not restricted, misalignment of the boxes and the ventilation apertures therein may restrict air passage in and out of the boxes which would prevent maintaining a desired temperature of the commodities packed in the boxes. Further, the cost of wood boxes, the greater weight of boxes constructed of wood rather than other materials, and the availability of wood as a raw material in light of the desirability of reducing the consumption of this natural resource, present further disadvantages in constructing shipping cartons from wood. In addition, wood cartons present a greater hazard of injury due to wood splinters and the nails used to construct such boxes.

It has been known to avoid such disadvantages by constructing shipping cartons of corrugated paperboard as an alternative to wood. Although corrugated paperboard cartons eliminate some of these disadvantages, they also possess certain disadvantages. For example, corrugated paperboard cartons generally lack the basic structural strength of wood boxes to support great weights for long periods of time and long distanaces. Secondly, under the above-discussed conditions of temperature and humidity, corrugated paperboard cartons more readily lose their structural integrity; and consequently, the capability of these cartons to be stacked is restricted. The ability to stack many cartons in a storage or transit vehicle for long periods of time, while maintaining a desired temperature of the commodities packed therein, is vital to a grower and/or packer. Heretofore a one-piece corrugated paperboard carton has not been found to be completely satisfactory in accomplishing these objectives. Also, the longer these cartons are subjected to cold, humid conditions, the greater the reduction in their stacking strength and ability to protect and maintain at a desired temperature the commodities being stored and/or shipped.

With the aforementioned disadvantages in mind, it is a general objective of this invention to provide an inexpensive, but strong, shipping carton capable of being stacked under extreme requirements of temperature and humidity while in storage and/or transit, as will most wooden boxes, and capable of allowing adequate ventilation of the commodities being stored or transported, without sacrificing any of the advantages corrugated paperboard cartons possess over their counterpart wooden boxes.

It is another object of this invention to provide a shipping carton having top to bottom stacking strength comparable to that of a wooden box, which is maintained even under conditions of extreme temperature and humidity for long periods of time.

It is a further object of this invention to provide a shipping carton having means for maintaining a particular stacking arrangement to insure that air may be circulated through the carton to maintain the commodities packed therein at a desired temperature.

These and other objects of this invention will be apparent to one skilled in the art from a consideration of this entire disclosure including the accompanying drawings.

SUMMARY OF THE INVENTION

The above objectives are accomplished, in accordance with this invention, by providing a shipping carton having a body wrap and separate end wall pieces. Prior to erection of this carton, the body wrap lies flat for economy of storage of many of these wraps. Upon erection of the carton, the body wrap is bent along crease lines between its portions to form a shell having openings at its ends. The end wall pieces are positioned in the openings and secured to the body wrap, whereby the carton is formed.

The body wrap has a bottom panel, side panels joined with the bottom panel, one or more top panels joined with the side panels, and an opening formed in each of its ends between the panels upon its erection. Rectangular flaps, adapted to be folded inwardly into the openings, extend from and are integral with the bottom and side panels. The end wall pieces positioned in the openings at the opposite ends of the body wrap are constructed of a multi-wall, corrugated board having at least its mediums and interior facings impregnated with a moisture resistant agent, such as a blend of polymeric heat curable resin, a paraffinic wax, an amount of catalyst sufficient to effectuate curing of the resin, water, and an organic liquid carrier. The carton is erected by folding the body wrap along crease lines joining the panels together and by then folding the inwardly extending flaps into the openings and securing these flaps to the end wall pieces. Preferably, apertures are provided in the side panels of the body wrap.

The apertures are preferably elliptical in shape and are positioned in the side panels between the top and bottom panels, the apertures in opposite side panels being aligned. Stacking tabs extend upwardly above the top of the carton. Preferably, the tabs extend upwardly from diagonally opposite top corners of the carton and have a structure corresponding to the structure of the bottom corners of a second similar carton stacked thereon, whereby the tabs prevent the relative shifting of the cartons.

The flaps integral with and extending from the bottom and side panels are folded inwardly and secured to the end pieces, preferably with glue. It has been found that the stacking strength of this carton may be enhanced, even under humid and cold conditions, by providing flaps which extend from the side panels the full height of these side panels from the top to the bottom panels, which permits a longer glue line that in turn develops a better bond with the end wall pieces.

DESCRIPTION OF THE PREFERRED EMBODIMENTS

Figure 1:
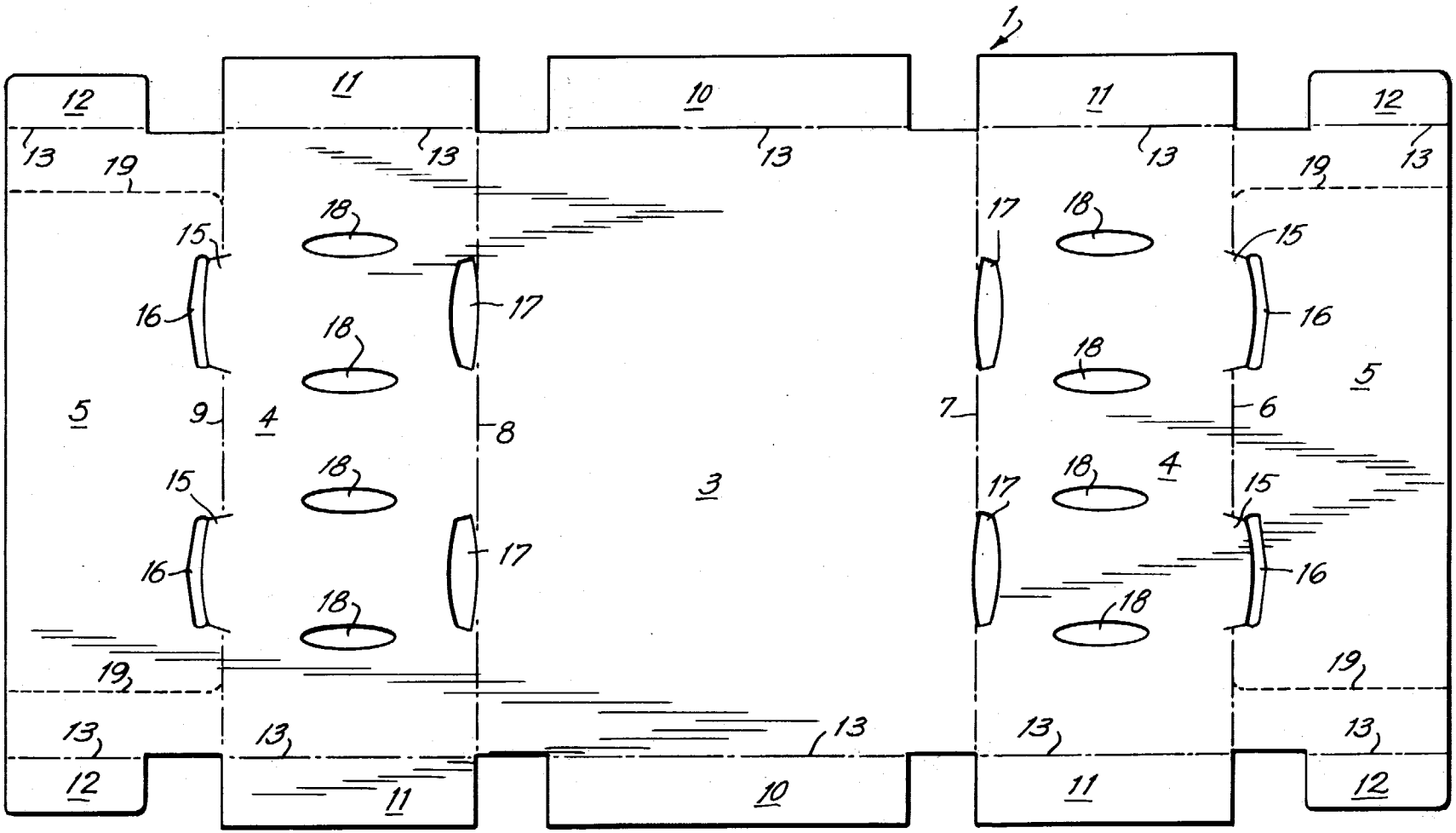
FIG. 1 is a plan view of a body wrap used in part to construct one embodiment of the shipping carton of this invention.
Figures 2, 3, 4:
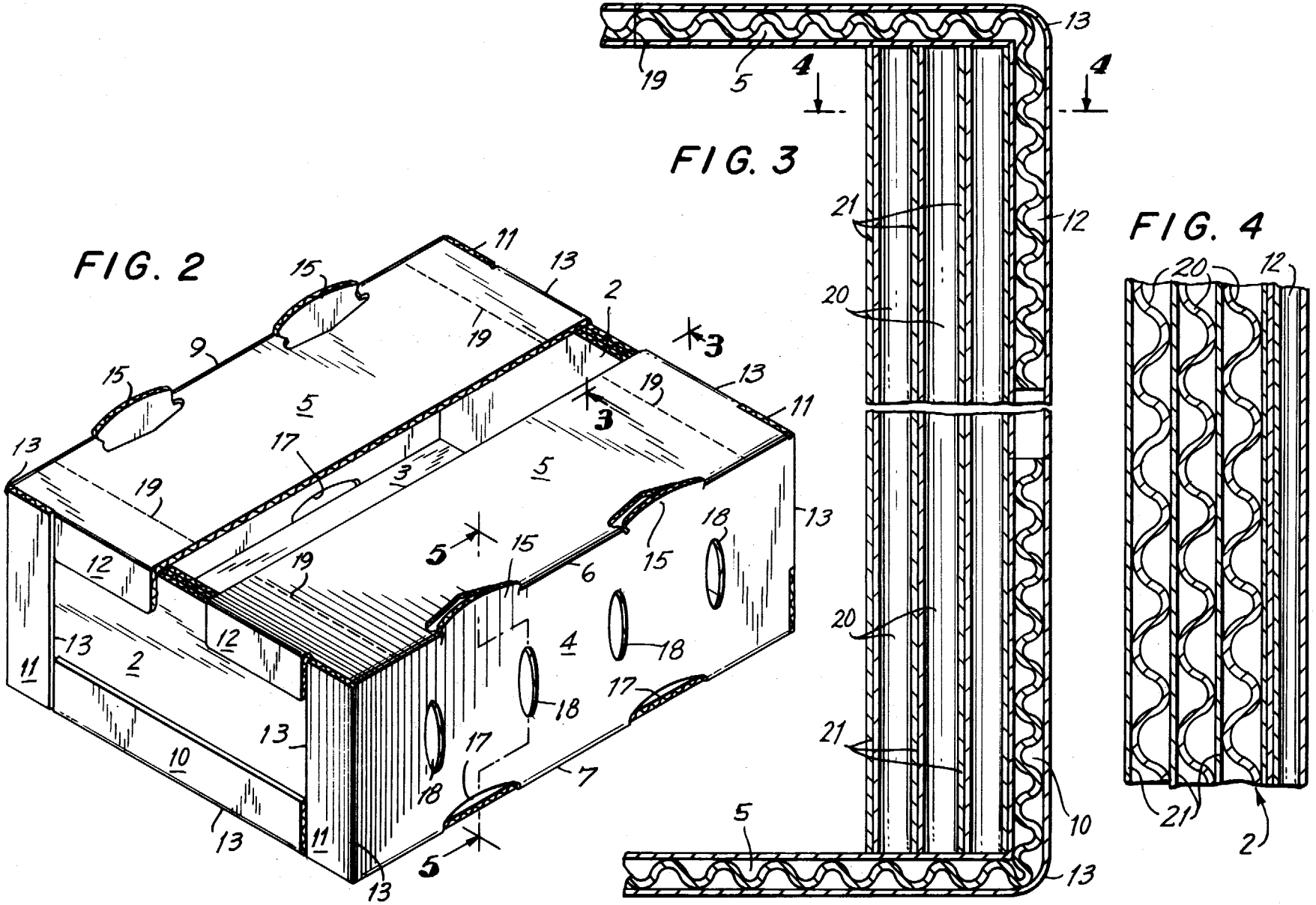
FIG. 2 is a perspective view showing the body wrap illustrated in FIG. 1 in an erected condition and end wall pieces positioned within the body wrap, together forming the carton of this invention.
FIG. 3 is a sectional view of the carton illustrated in FIG. 2 taken along line 3—3 of FIG. 2.
FIG. 4 is a sectional view of the carton illustrated in FIG. 2 taken along line 4—4 of FIG. 3.

One preferred embodiment of a shipping carton of the present invention is shown in FIGS. 1–6. The carton is erected from a body wrap, generally designated 1 as shown in FIG. 1, and separate end wall pieces, generally designated 2 as shown in FIG. 2. Body wrap 1 is constructed of corrugated paperboard, although if desired, other materials known in the art may be utilized. Body wrap 1 has a bottom panel 3, two side panels 4, and two top panels 5. To erect the carton, body wrap 1 is folded or bent along crease lines 6, 7, 8, and 9 which are, respectively, between top, side, and bottom panels 3, 4, and 5, as illustrated in FIG. 1. It is apparent from FIG. 2 that the two top panels are separated from each other so that the carton may be packed and closed, after which top panels 5 are secured to end wall pieces 2. The amount of separation between top panels 5 is dependent upon the particular needs of the carton and can be varied. Further, it is contemplated that a single top panel 5 may be employed in the carton of this invention, where such a panel is either part of body wrap 1 and attached to side panel 4 or not part of body wrap 1 and secured to the carton after its erection by the flap means described below or by other means.

Upon erection of the carton, by folding or bending of body wrap 1 along the crease lines 6–9, an opening is formed in the opposite ends of the body wrap between panels 3, 4, and 5. To complete assembly of the carton, end wall pieces 2 are inserted in these openings and secured to panels 3, 4, and 6 by flaps 10, 11, and 11. As shown in FIG. 1 and 2, flaps 10, 11, and 12 are integrally connected to panels 3, 4, and 5 by fold lines 13. It is contemplated that the top panel or panels employed in the cartons of this invention may be secured to the side panels and end wall pieces by means other than flaps 12 and that flaps 12 may be eliminated to accomplish any particular desired objective. In the carton of the present invention, it is preferred to glue flaps 10, 11, and 12 to end wall pieces 2.

It is believed that, in part, superior stacking strength of these cartons is achieved over prior art cartons because flaps 11 are rectangular and the height of these flaps is substantially equal to the height of the carton. In other words flaps 11 extending from side panels 4 extend the full height of side panels 4 from top panels 5 to the bottom panel 3.

This invention additionally provides means for insuring the correct stacking of one carton upon another to prevent the relative shifting of the cartons and means for allowing ventilation of the carton to maintain a desired temperature of the contents packed within.

Figure 5:
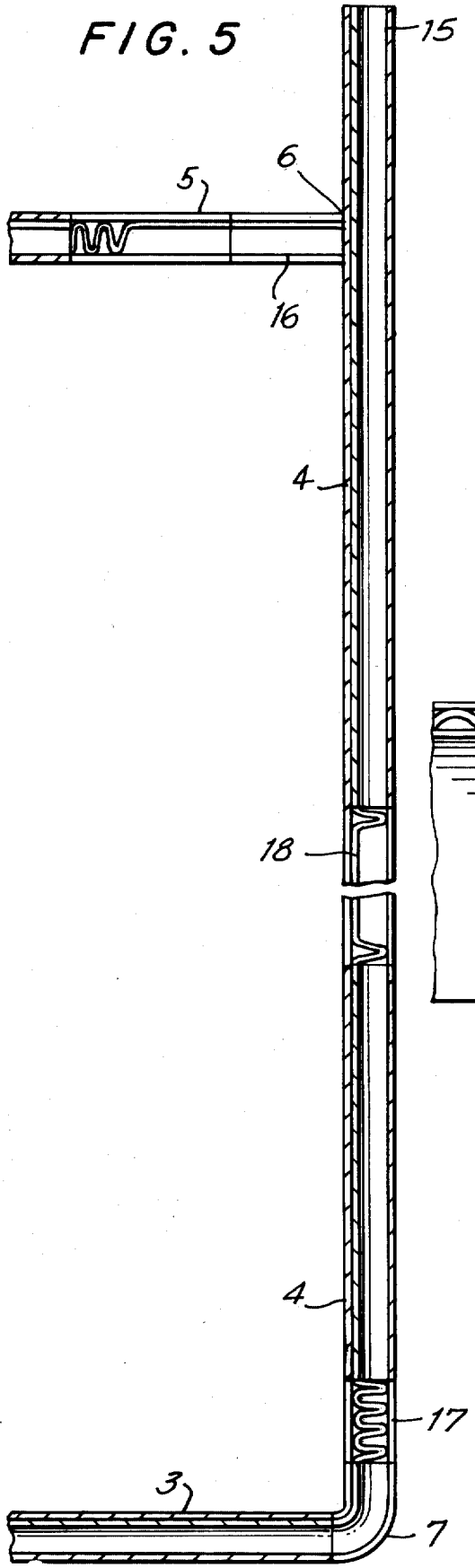
FIG. 5 is a partial sectional view of the carton illustrated in FIG. 2 taken along line 5—5 of FIG. 2.

Stacking tabs 15 are provided on crease lines 6 and 9 between side panels 4 and top panels 5, which upon the placing of one carton upon another, align the top carton with the lower carton to prevent shifting and misalignment of the cartons. As illustrated in FIG. 5, each stacking tab 15 extends upwardly from side panel 4. Although the embodiment of the shipping carton of this invention shown in FIGS. 1–6 utilizes stacking tabs 15 that protrude upwardly from the top of side panels 4, it is contemplated that the stacking tabs can be provided generally on the creases between the side and top panels or on the outer surface of side panels 4. It has been found that stacking tabs which are shorter in height and longer in base are less susceptible to damage during stacking and less bendable, providing better alignment of the cartons and more dependable stacking.

As shown in FIG. 1, stacking tabs 15 are cut from top panels 5 in body wrap 1. A space 16 is provided between the top of each of the stacking tabs 15 and the adjoining portions of top panels 5, so that delamination of the stacking tabs upon erection of the carton is prevented.

Although stacking tabs 15 could be constructed to rest upon the outer surfaces of side panels 4 of one carton placed above another to secure the top carton, it has been found that by providing cut-out areas 17, corresponding to the structure of the stacking tabs, generally in each of side panels 4 adjacent creases 7 and 8 between bottom panel 3 and side panels 4, more secure stacking of one carton to another can be achieved. Upon stacking of the cartons, stacking tabs 15 of the lower carton mate with cut-out areas 17 in the carton above to secure the cartons to each other.

An additional feature of body wrap 1 is the provision of elliptically shaped apertures 18 in side panels 4. Although apertures in the side panels of shipping cartons have been utilized in the past, it has been found that elliptically shaped apertures are preferred because they provide the greatest amount of ventilation and the smallest reduction in stacking strength, i.e., elliptical apertures minimize the extent to which the cross sectional area of the side panels is reduced. Apertures of this particular shape are also preferred because it is common to pack produce in one or more layers in a shipping carton. Thus, by providing elliptically shaped apertures in side panels 4 of the carton, visibility of more than one layer of produce is provided as compared to having either circular or some other shaped aperture which may prevent the viewing of produce packed within the carton.

As illustrated in FIGS. 1 and 2, apertures 18 are positioned substantially centrally in side panels 4 between creases 6 and 9 joining the side and top panels and creases 7 and 8 joining the side and bottom panels. As one alternative, apertures 18 may be positioned in side panels 4 between the top and bottom panels, adjacent to or in creases 6–9. Further, the apertures in the side panels 4 are aligned. It has been found that by placing apertures 18 in each of the side panels 4 at approximately the same position, that ventilation and cooling, if desired, of the contents within the carton is enhanced because of the straight through flow of air from apertures 18 on one side panel 4 to apertures 18 on the other side panel 4. Although the shipping cartons of the present invention have been illustrated as having four apertures 18 on each side panel 4, it is within the scope of this invention that the number of apertures 18 can be increased or decreased to fulfill the particular requirements of ventilation and/or cooling of the contents packed within the carton. Also, although alignment of the apertures 18 on one side panel with the apertures 18 on the other side panel has been found to be preferred, any other particular arrangement of the apertures may be utilized to accomplish a particular desired objective without deparing from the spirit of this invention.

To further increase ventilation through the carton, ventilation apertures may be made in top panels 5; especially if a single top panel is employed.

Figure 6:
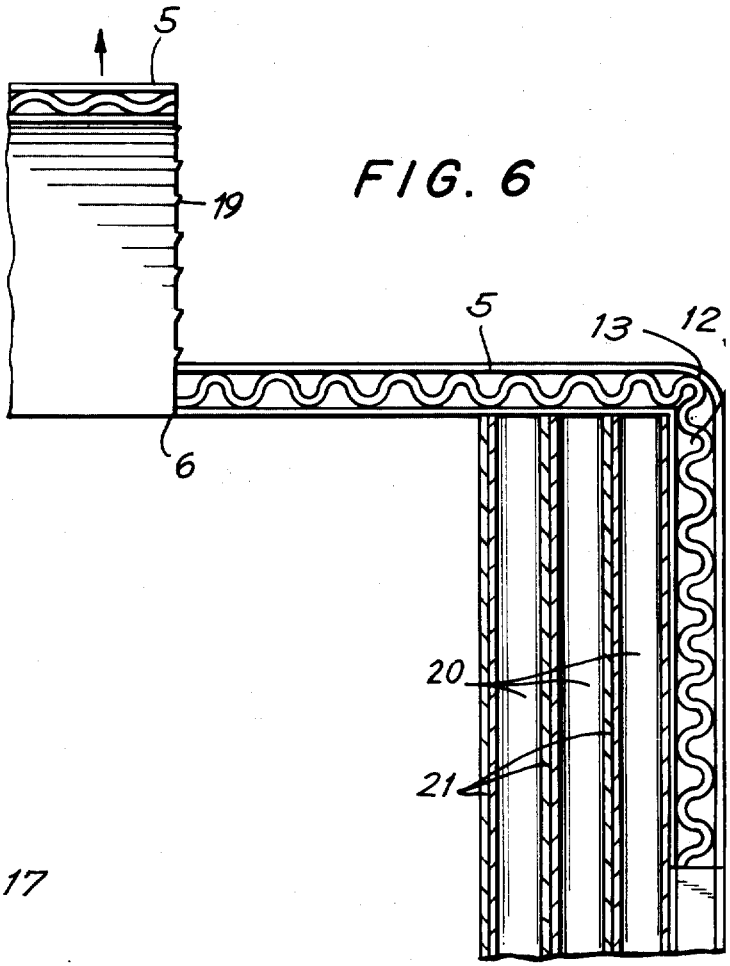
FIG. 6 is a partial sectional view of the carton illustrated in FIG. 2, similar to FIG. 3, showing a portion of the top of the carton opened upwardly.

An additional feature of body wrap 1, is the perforation lines 19 on top panels 5 of body wrap 1. Once the carton has been erected and the flaps 12 extending from top panels 5 have been secured to end wall pieces 2, the contents packed within the carton may still be inspected or removed by lifting upwardly on top panels 5 between perforation lines 19. In FIG. 2, the carton is shown intact before the portions of top panels 5 surrounding perforation lines 19 have been separated. FIG. 6 illustrates a portion of top panel 5 which has been separated from panel 5 by lifting upwardly on this panel approximate perforation lines 19. As illustrated in FIg. 6, perforation lines 19 have a rough edge, so that after opening, top panels 5 can be closed and substantially reunited by joining the rough edges of perforation lines 19 with the remaining portions of the panel. Although the embodiment of the shipping carton of this invention illustrated in FIG. 2 and 6 perforation lines 19 extend from the innermost edge of top panels 5 to creases 6 and 9 joining top panels 5 and side panels 4, perforation lines 19 may be shortened so as not to extend to these creases. Thus, only a portion of each panel 5 between the perforation lines 19 may be openable.

In addition to body wrap 1, separate end wall pieces 2 are inserted in the openings at opposite ends of body wrap 1 formed between bottom, side, and top panels 3, 4, and 5 upon erection of these cartons. End wall pieces 2 are constructed of multi-wall, corrugated board, which provides a primary source of stacking strength of these cartons. It is preferred that end wall pieces 2 be of a triplewall construction. It is further preferred that these triplewall end wall pieces 2 be manufactured from corrugated paperboard having three mediums 20 enclosed by four facings 21. As discussed above, under the conditions of humidity and cold temperatures in which produce is stored and/or transported, the cartons utilized for storing and/or transporting of the produce must not only be capable of maintaining the produce packed in these cartons at a desired temperature, but also must be capable of maintaining their stacking strength or top to bottom compression strength under such conditions for long periods of time. It has been found that the stacking strength of the cartons of the present invention can be maintained and is enhanced by impregnation of the end wall pieces 2 with one or more moisture resistant agents. Several moisture resistant agents may be utilized in the impregnation of the end wall pieces 2 in the cartons of the present invention. Thus, in addition to the stacking strength contributed to the shipping cartons of this invention by the basic structure of these cartons, impregnation of the end wall pieces 2 with moisture resistant agents further increases the stacking strength of these cartons.

Figure 7:
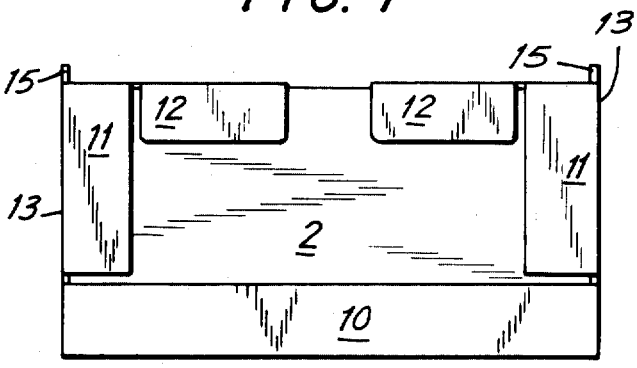
FIG. 7 is a view of an alternative structure of the shipping carton of this invention shown in FIG. 2.

In another preferred embodiment of a shipping carton of this invention illustrated in FIG. 7, body wrap 1 and end wall pieces 2 are formed into the carton as described above, however, the flaps 11 extending from and integral with the side panels 4 do not extend from these side panels the entire height between top panels 5 and bottom panel 3. Rather, side panels 11 extend from top panels 5 only partially the height of side panels 4 and the flap 10 extending from and integral with bottom panel 3 extends the full width of bottom panel 3, from one to the other of side panels 4. Other modifications which may be made to the shipping cartons of this invention include impregnation of the body wrap with moisture resistant agents, substitution of stock combinations of which the carton is constructed, and structural modifications to increase ventilation through the carton. For example, the body wrap may be wax or resin impregnated and may be made of corrugated paperboard composed of various combinations of mediums and facings. The end panel pieces may have beveled corners allowing greater channel air flow through the carton. Thus, depending upon the requirements of use of the cartons of the present invention and the minimun quantity of stacking strength necessary, the structure of these cartons may be varied without departing from the spirit of this invention.

A shipping carton of the present invention which has been found to provide excellent stacking strength has the following structure:

Stock Combination (lbs./1000 sq. ft.)

Body Panels — 42 (F) — 42 (F) — 33 (M) — 90 (F)

End Panels — 62 (F) — 33 (M) — 38 (F) — 33 (M) — (F) — 62 (F)

where the body panels have a "C" fluting, the end panels have a "CAA"fluting, and both the body and end panels are treated with 21 lbs./1,000 sq. ft. and 85 lbs./1,000 sq. ft., respectively, of a water resistant resin.

To further increase the stacking strength of the shipping cartons of this invention, end wall pieces 2 are impregnated with one or more moisture resistant agents. It has been found that by impregnating at least the mediums and interior facings of the corrugated paperboard used in forming these end wall pieces with an agent comprising a blend of a polymeric heat curable impregnated, a paraffinic wax, an amount of a catalyst sufficient to effectuate curing of the impregnate, water, and an organic liquid carrier, that the wet strength of these cartons is increased. The impregnated board typically contains from about 4 to about 50%, by weight, and preferably from about 8 to about 20%, by weight, of agent. Several known apparatus and methods useful in improving the wet strength of corrugated paperboard cartons can be used to impregnate, as described above, the end wall pieces. Further, several impregnates may be utilized which impart wet rigidity to the shipping cartons of this invention. One particularly useful impregnate includes a urea-formaldehyde resin, a paraffinic wax, a minimum amount of a catalyst to effectuate curing of the urea-formaldehyde resin, with the remainder of the composition being a mixture of water and alcohol. If preferred, body wrap 1 or end wall pieces 2 may also be impregnated with, for example, a wax.

Figure 8:
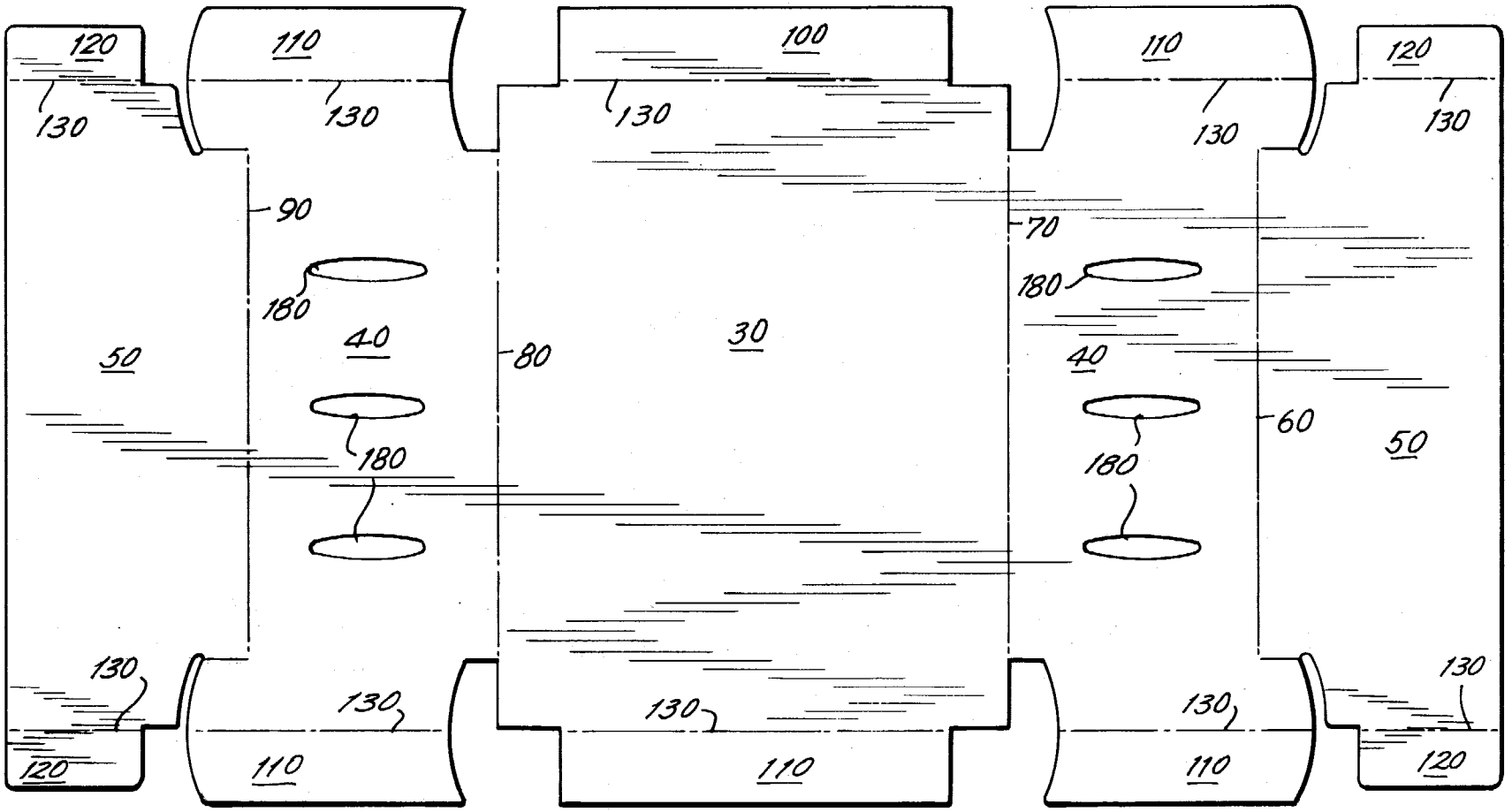
FIG. 8 is a plan view of another body wrap used in part to construct another embodiment of the shipping carton of this invention.
Figure 10:
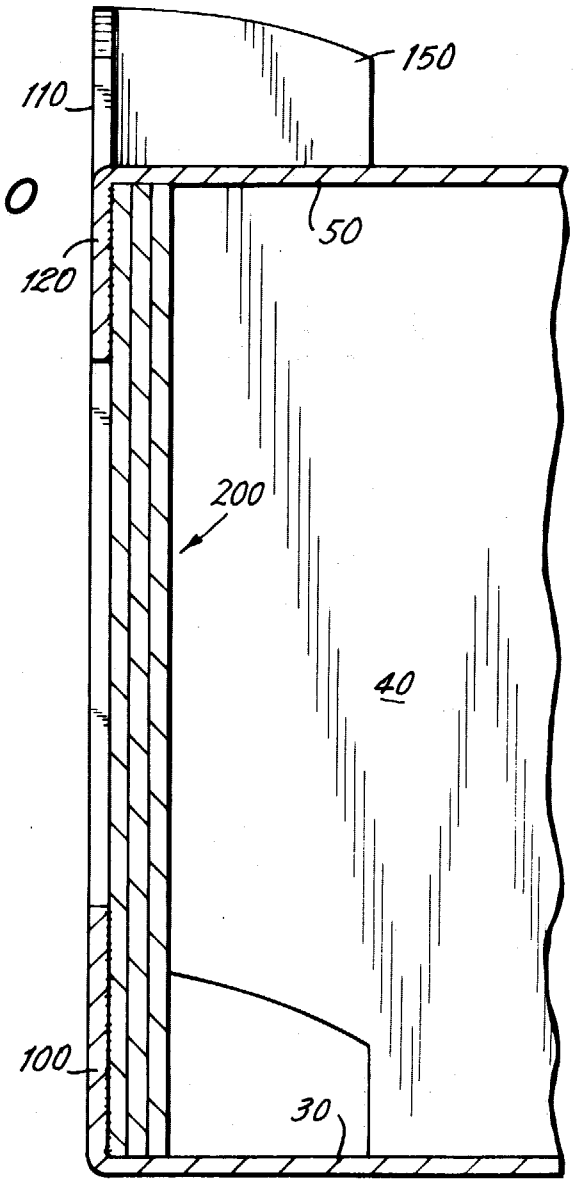
FIG. 10 is a sectional view of the carton illustrated in FIG. 9 taken along line 10—10 of FIG. 9.
Figure 9:
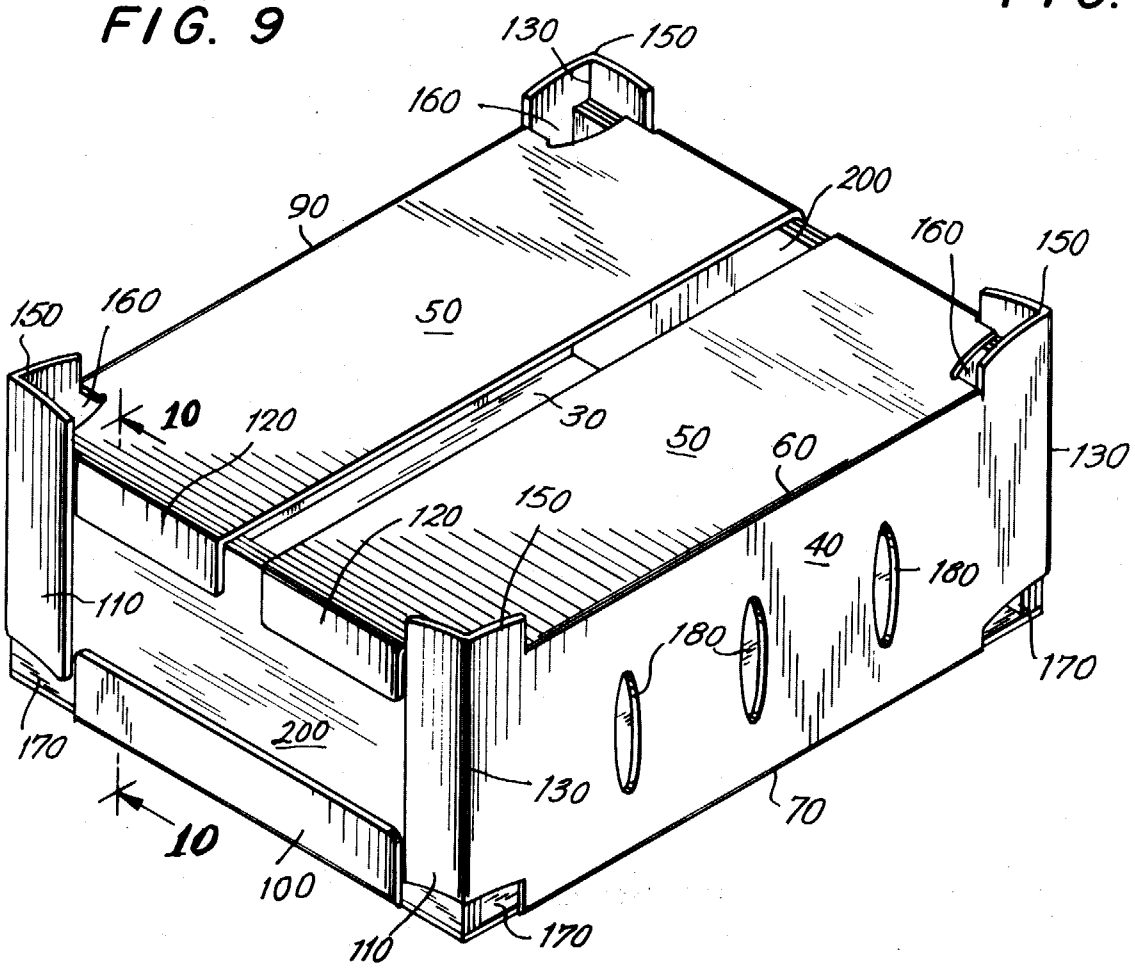
FIG. 9 is a perspective view showing the body wrap illustrated in FIG. 8 in an erected condition and end wall pieces positioned within the body wrap, together forming the carton of this invention.

Another embodiment of the shipping carton of this invention is shown in FIGS. 8–10.

In FIG. 8, a body wrap which in part forms this shipping carton is shown. The wrap is similar in structure to the body wrap shown in FIG. 1 and has a bottom panel 30, two side panels 40, and two top panels 50, integrally connected by crease lines 60, 70, 80 and 90. Extending from panels 30, 40, and 50 are flaps 100, 110, and 120, which are integrally connected to the panels by crease lines 130. As discussed in detail above, apertures are provided in the cartons of this invention for insuring proper ventilation through the cartons and in this embodiment, apertures 180 are provided in panels 40.

Referring to FIG. 9, the erected shipping carton is illustrated. The body wrap of FIG. 8 has been folded to provide openings at its ends in which end wall pieces 200 have been inserted to complete formation of the carton.

Flaps 100, 110, and 120 are preferably glued to end wall pieces 200 and as evident from FIG. 9, in this embodiment flaps 110 do not extend the full height of side panels 40 from bottom panels 30 to top panels 50. Rather, cut-out areas 170 are provided at each bottom corner of the carton. These cut-out areas serve two functions. First, when several of these cartons are in a stacked arrangement, ventilation around the perimeter of and through the carton is effected through the cut-out areas. This type of ventilation prevents "hot spots" in the most difficult areas of the carton to ventilate, the corners. However, if desired, cut-out areas 170 may be eliminated, so that the flaps extend the full height of the side panels.

The second function of cut-out areas 170 is for ease in stacking one carton upon another. In this regard, cut-out areas 170 and stacking tabs, identified as 150, accomplish a stacking function in the cartons of the present invention.

Stacking tabs 150 extend upwardly above the top of the carton and have a structure corresponding to the structure of the bottom corners of a second similar carton to be stacked thereon, whereby the tabs prevent the relative shifting of the cartons. In this case, tabs 150 will mate with cut-out areas 170 at the bottom corners of a second carton. It has been found that tabs having essentially a V-shaped structure maintain the corners of the stacked carton in a fixed position. Thus, relative movement of one carton stacked on another in any direction is prevented. It is to be understood that if cut-out areas 170 were eliminated, then tabs 150 could be appropriately structured to abut the bottom corners of such a carton.

Preferably, the tabs extend upwardly above the carton from at least two diagonally opposite top corners of the carton and each tab extends upwardly from a side panel and its integrally connected flap. Also, spaces, identified as 160, are provided in top panels 50 adjacent the stacking tabs for additional ventilation of the carton.

These and other embodiments of this invention will be apparent to those skilled in the art in view of this disclosure.

What is claimed is:

1. A shipping carton adapted for storage and transport of produce under cold and humid conditions comprising a body wrap and a pair of separate substantially rigid end panels, said body wrap comprising:

a rectangular bottom panel, a pair of side panels each comprising a wall integrally connected with one of the opposite sides of the bottom panel by a fold line along which said wall is folded to extend vertically upward from said bottom panel, a pair of top closure panels each integrally connected with one of said side panels by a fold line defining the upper margin of said side panel and along which said top panel is folded when said carton is closed, said substantially rigid end panels each comprising:

a rectangular multi-wall adhesively laminated corrugated board made up of at least two corrugated mediums enclosed by facing boards, each end panel having top, bottom and end edges, and at least said mediums and the interior facing boards being impregnated with a moisture resistant rigidifying agent, a pair of bottom panel flaps integral with said body wrap and each integrally connected with one end margin of said bottom panel by a fold line along which said flap is folded upwardly to lie upon the outer surface of one of said separate end panels thus to secure said bottom panel to both of said end panels with said end panels extending vertically upwardly from said bottom panel with the bottom edges thereof resting on said bottom panel, four side panel flaps each integrally connected with one vertically extending side margin of each of said side panels of said body wrap by a fold line along which said flap is folded to lie upon the outer surface of one of said separate end panels with the inner surface of the adjacent side panel extending firmly in contact with the adjacent end edge of said end panel, each of said four side panel flaps extending vertically in secured contact with said outer surface of the adjacent end of one of said end panels from substantially the level of said bottom panel to the top margin of said end panel, stacking tabs extending upwardly from the top margins at least of each of said side panels and through openings formed in said top panels.

each of said stacking tabs being bolstered for rigidity as a result of said contact of said inner walls of said side panels with the opposite end edges of said separate end panels, and the end walls of each of said side panels having cut-out areas corresponding with said stacking tabs and positioned at the bottom corners of said body wrap whereby the stacking tabs of said carton will mate with similar cut-out areas in a second similar carton to be stacked thereupon to essentially prevent said second carton from shifting relative to the body wrap of said carton.

2. A shipping carton adapted for storage and transport of produce under cold and humid conditions comprising a body wrap and a pair of separate substantially rigid end panels, said body wrap comprising:

a rectangular bottom panel, a pair of side panels each comprising a wall integrally connected with one of the opposite sides of the bottom panel by a fold line along which said wall is folded to extend vertically upward from said bottom panel, a pair of top closure panels each integrally connected with one of said side panels by a fold line defining the upper margin of said side panel and along which said top panel is folded when said carton is closed, said substantially rigid end panels each comprising:

a rectangular multi-wall adhesively laminated corrugated board made up of at least two corrugated mediums enclosed by facing boards, each end panel having top, bottom and end edges, and at least said mediums and the interior facing boards being impregnated with a moisture resistant rigidifying agent, a pair of bottom panel flaps integral with said body wrap and each integrally connected with one end margin of said bottom panel by a fold line along which said flap is folded upwardly to lie upon the outer surface of one of said separate end panels thus to secure said bottom panel to both of said end panels with said end panels extending vertically upwardly from said bottom panel with the bottom edges thereof resting on said bottom panel, four side panel flaps each integrally connected with one vertically extending side margin of each of said side panels of said body wrap by a fold line along which said flap is folded to lie upon the outer surface of one of said separate end panels with the inner surface of the adjacent side panel extending firmly in contact with the adjacent end edge of said end panel, each of said four side panel flaps extending vertically in secured contact with said outer surface of the adjacent end of one of said end panels from substantially the level of said bottom panel to the top margin of said end panel, stacking tabs extending upwardly from at least two diagonally opposite top corners of said body wrap each of said stacking tabs being formed integrally with and extending jointly upwardly from a side panel flap and the adjacent side panel, each of said stacking tabs being V-shaped and being bolstered for rigidity by the walls of said side panels and by the opposite end edges of said separate end panels, and the walls of each of said side panels having cut-out areas corresponding with said stacking tabs and positioned at the bottom corners of said body wrap whereby the stacking tabs of said carton will mate with similar cut-out areas in a seond similar carton to be stacked thereupon to essentially prevent said second carton from shifting relative to the body wrap of said carton.

* * * * *